US005737427A

United States Patent [19]

Ambourn

[11] Patent Number: 5,737,427

[45] Date of Patent: Apr. 7, 1998

[54] SURROUND SOUND PROCESSOR UNIT

[76] Inventor: Paul R. Ambourn, 26 Scotch Pine Rd., North Oaks, Minn. 55127

[21] Appl. No.: 708,839

[22] Filed: Sep. 9, 1996

[51] Int. Cl.[6] ..... H04R 5/00

[52] U.S. Cl. ..... 381/18; 381/120; 381/14

[58] Field of Search ..... 381/1, 24, 18, 381/17, 120, 14

[56] References Cited

U.S. PATENT DOCUMENTS

| | | | |
|---|---|---|---|
| 3,757,047 | 9/1973 | Ito et al. | 381/18 |
| 3,941,931 | 3/1976 | Osakabe | 381/1 |
| 4,002,835 | 1/1977 | Bumber . | |
| 4,049,912 | 9/1977 | Mitchell . | |
| 4,097,688 | 6/1978 | Ochi . | |
| 4,495,637 | 1/1985 | Bruney | 381/1 |
| 4,594,729 | 6/1986 | Weingartner | 381/18 |
| 4,612,663 | 9/1986 | Holbrook et al. | 381/24 |
| 4,899,388 | 2/1990 | Mlodzikowski et al. | 381/77 |
| 4,908,858 | 3/1990 | Ohno | 381/1 |
| 5,197,100 | 3/1993 | Shiraki | 381/24 |

OTHER PUBLICATIONS

"Lenear Applications", Radio Shack, vol. 1, p. AN20–3, Feb. 1969.

*Primary Examiner*—Curtis Kuntz

*Assistant Examiner*—Vivian Chang

*Attorney, Agent, or Firm*—Donald J. Ersler

[57] ABSTRACT

A surround sound processor unit includes a plurality of preamplifiers, an in-phase audio decoder circuit, an out-of-phase audio decoder circuit, at least one transmitter, at least one receiver, at least one speaker amplifier, and a plurality of power amplifiers. A surround sound processor unit can take the stereo audio signal from a stereo VCR, a stereo receiver, a headphone jack, a stereo TV, or a car stereo to produce a three dimensional sound field. The left audio signal is amplified and outputed to a left front speaker. The right audio signal is amplified and outputed to a right front speaker. The in-phase audio decoding is accomplished by preamplifying the left and right audio signal, and connecting the output of the left and right preamplifiers to a singular input of a power amplifier. The output of the power amplifier drives a center channel speaker. The out-of-phase audio decoding is accomplished by inputing the left audio signal into a transmitter, and connecting the right audio signal to the ground of the transmitter. A transmitted signal is received by a receiver and amplified by a speaker amplifier which drives a rear speaker or subwoofer. The surround sound processor unit can also be configured for hard wire operation. Another preferred embodiment does not include power amplifiers, but allows the user to provide power amplifiers to their liking. Yet another preferred embodiment is a three channel add-on unit which is used in conjunction with a stereo receiver.

20 Claims, 3 Drawing Sheets

SURROUND SOUND PROCESSOR UNIT

1. Field of the Invention

The present invention relates generally to surround sound processor systems and more specifically to a surround sound processor unit that is less complicated and more economical than that of the prior art.

2. Discussion of the Prior Art

Surround sound processors are normally used to decode audio signals which are recorded on the sound tracks of video cassettes and discs. However, these surround sound processors use complicated circuitry to accomplish two basic signal processing functions. The first signal processing function is the decoding of in-phase audio signals, and the second signal processing function is the decoding of out-of-phase audio signals, from a stereo signal source. The in-phase audio signals are sent to a center speaker. The out-of-phase audio signals are sent to at least one rear speaker.

In a normal surround sound system, there are five speakers, there are two stereo speakers in the front, a center speaker positioned between the two stereo speakers and two rear speakers in the back. The five speakers create a three dimensional sound field similar to that found in a modern movie theater.

The prior art surround sound processor units have complicated decoder circuitry which necessitates an expensive selling price. The prior art surround sound processor units are either a three channel add on unit which includes power amplifiers and which is used in conjunction with a stereo receiver, or a five channel stand alone unit which has power amplifiers for all five channels instead of three channels. With the prior art surround sound processor units, the placement of rear speakers and subwoofers are constrained by routing speaker wires throughout the viewing room. The prior art surround sound processor units do not facilitate wireless operation for rear speakers or for subwoofers.

Accordingly, there is a clearly felt need in the art for a surround sound processor unit that has a less complicated design, an economical price, and which allows the user to locate speakers anywhere in a viewing room without the frustration of having to route speaker wires.

SUMMARY OF THE INVENTION

The primary objective of the present invention is to provide a surround sound processor system which has a less complicated design, an economical price, and which allows the user to locate speakers anywhere in a viewing room without the frustration of having to route speaker wires.

According to the present invention, a surround sound processor unit includes a plurality of pre-amplifiers, an in-phase audio decoder circuit, an out-of-phase audio decoder circuit, a transmitter, at least one receiver, at least one speaker amplifier, and a plurality of power amplifiers. A stereo audio signal includes a left audio signal and a right audio signal. The stereo audio signal can come from a stereo VCR audio out, a home stereo receiver preamplifier out, a headphone jack, a stereo TV audio out, or a car stereo preamplifier out.

The left audio signal is connected to a left preamplifier, a first center preamplifier, and a first rear preamplifier. The right audio signal is connected to a right preamplifier, a second center preamplifier, and a second rear preamplifier. The output signals from the left and right preamplifiers are input into a left and right power amplifier which are used to drive the left and right speakers, respectively. The output signals from the first and second center preamplifiers are connected together to form an in-phase audio decoder circuit. The output signal from the in-phase audio decoder circuit is input into a center power amplifier which is used for driving the center speaker.

The output signal from the first rear preamplifier is input into the transmitter and the output signal from the second rear preamplifier is connected to a ground of the transmitter. The out-of-phase audio decoder circuit is formed by the connections between the transmitter, the first rear preamplifier and the second rear preamplifier. The out-of phase signal is transmitted to at least one receiver which feeds the signal to at least one speaker amplifier. The output from the speaker amplifier can drive at least one rear speaker or a subwoofer. Two isolated DC power supplies are preferably used. The first DC power supply drives the plurality of preamplifiers. The second DC power supply drives the transmitter and the plurality of power amplifiers. The grounds of the both DC power supplies float in relation to each other.

In a second preferred embodiment, the power amplifiers are removed from the first preferred embodiment. The surround sound processor unit is only a preamplifier. The user can choose power amplifiers to compliment the power requirements of the speakers used in the surround sound system. A lack of speaker wire routing can also be an added advantage.

In a third preferred embodiment, the rear speaker may be hard wired to the surround sound processor unit. The rear speaker is driven by a rear power amplifier which is contained within the surround sound processor unit. The audio circuitry for driving the left speaker, right speaker and center speaker are identical to the first embodiment. The output of the first rear preamplifier is connected to the signal input of a rear power amplifier and the output of the second rear preamplifier is connected to the ground thereof. The output of the rear amplifier can be used to drive at least one rear speaker. A subwoofer may also be driven by the rear amplifier by wiring thereof in parallel with at least one rear speaker.

In a fourth preferred embodiment, the power amplifiers are removed from the third embodiment. The surround sound processor unit is only a preamplifier. The user can choose power amplifiers to compliment the power requirements of the speaker used in the surround sound system.

In a fourth preferred embodiment, the power amplifiers are removed from the third preferred embodiment. The surround sound processor unit is only a preamplifier. The user can choose power amplifiers to compliment the power requirements of the speaker used in the surround sound system.

In a fifth preferred embodiment, the surround sound processor unit is only a three channel add-on unit as opposed to a five channel stand alone unit. The three channel add-on unit is used in conjunction with a stereo receiver. The three channel unit is driven by a tape out, a headphone jack, a car stereo preamplifier out, or a preamplifier out from the stereo receiver. The three channel add-on unit does not include a left preamplifier, a right preamplifier, a left amplifier, or a right amplifier.

Accordingly, it is an object of the present invention to provide a surround sound processor unit that has less complicated decoding circuitry than that of the prior art.

It is a further object of the present invention to provide a surround sound processor unit that is less expensive than that of the prior art.

It is yet another object of the present invention to provide a surround sound processor unit which can have wireless operation instead of the burdensome hard wire operation of the prior art.

These and additional objects, advantages, features and benefits of the present invention will become apparent from the following specification.

DETAILED DESCRIPTION OF THE PREFERRED EMBODIMENTS

Figure 1:
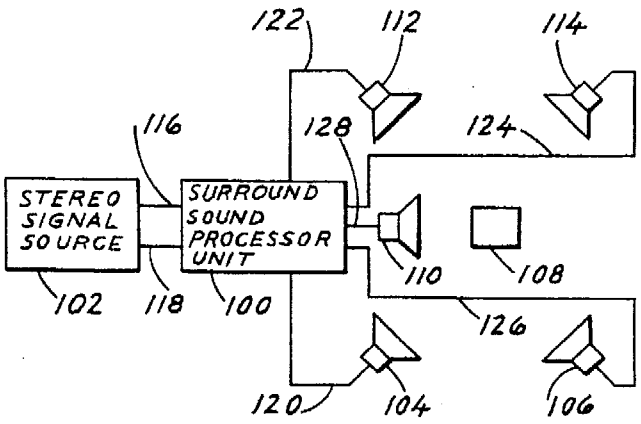
FIG. 1 (PRIOR ART)
FIG. 1 is a block diagram of a prior art five channel surround sound processor unit.

With reference now to the drawings, and particularly to FIG. 1, there is shown a prior art five channel stand alone surround sound processor unit 100. A stereo signal source 102 outputs a left audio signal 116 and a right audio signal 118 into a surround sound processor unit 100. The stereo signal source 102 can be a stereo VCR, a stereo receiver, a car stereo, or a stereo TV.

The surround sound processor unit 100 decodes and amplifies the left audio signal 116 and the right audio signal 118 into a three channel output. The five channel output comprises a left front speaker 112, a right front speaker 104, a center speaker 110, a left rear speaker 114, and a right rear speaker 106. A left front audio signal 122 is an amplified version of the left audio signal 116. A right front audio signal 120 is an amplified version of the right audio signal 118. An in-phase audio signal 128 is decoded from the left audio signal 116 and the right audio signal 118 and is output to the center channel speaker 104. A left out-of-phase audio signal 124 is decoded from the left audio signal 116 and the right audio signal 118 and is output to the left rear speaker 114 and the right rear channel 126. A right out-of phase audio signal 126 is decoded from the right audio signal 116 and the right audio signal 118 and is output to the right rear speaker 106. A listener sits at a location 108 and hears a three dimensional sound field, similar to that in a modern movie theater.

Figure 2:
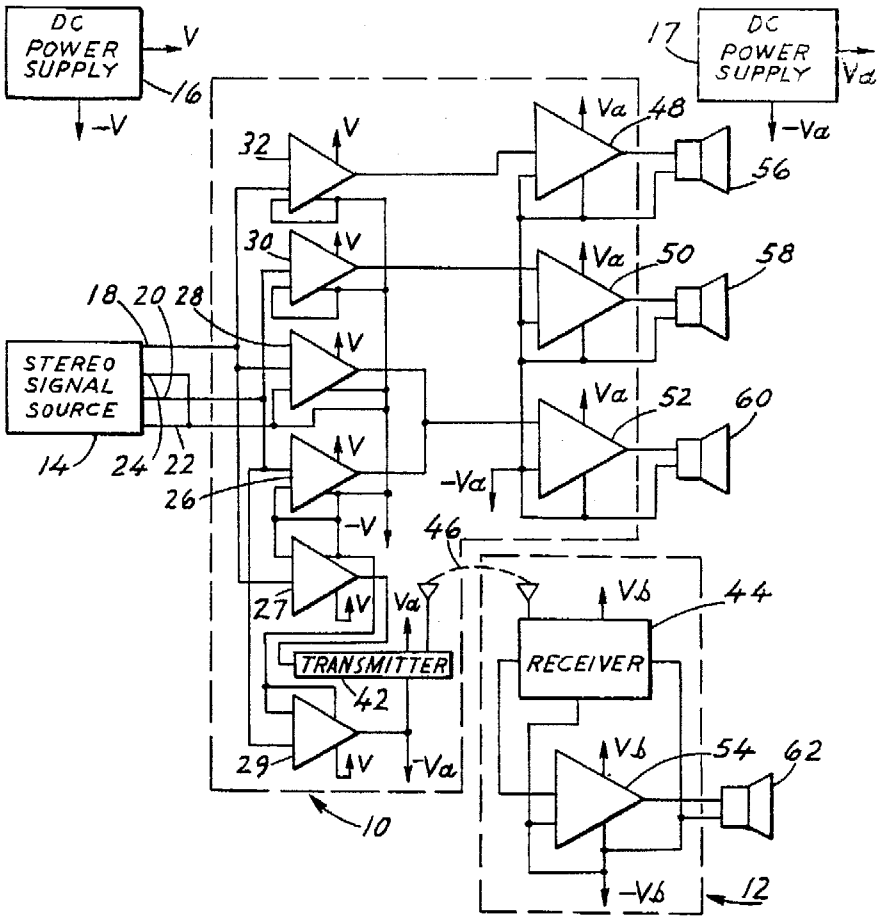
FIG. 2 is a schematic diagram of a first preferred embodiment of a surround sound processor unit in accordance with the present invention.

FIG. 2 shows a schematic diagram of a first preferred embodiment of a surround sound processor unit 10. A stereo signal source 14 supplies a left audio signal 18, a right audio signal 20, a left audio signal ground 24, and a right audio signal ground 22. The stereo signal source 14 may be a stereo VCR audio out, a home stereo receiver preamplifier out, a stereo TV audio out, a car stereo preamplifier out, or a headphone jack. The left audio signal ground 24 and the right audio signal ground 22 are both connected to a ground of a first DC power supply 16.

The left audio signal 18 is inputed into a left preamplifier 32, a first center preamplifier 28, and a first rear preamplifier 27. The right audio signal 20 is inputed into a right preamplifier 30, and a second center preamplifier 26, and a second rear preamplifier 29. The left preamplifier 32 is connected to the input of a left power amplifier 48. The right preamplifier 30 is connected to the input of a right power amplifier 50. The output of the first center preamplifier 28 and the second center preamplifier 26 are both input into a center power amplifier 52. The connection of the output signals from the first center preamplifier 28, and the second center preamplifier 26, to the input of the center power amplifier 52 form an in-phase audio decoder circuit.

The output signal from the first rear preamplifier 27 is input into the transmitter 42 and the output signal from the sixth preamplifier 29 is connected to a ground of the transmitter The out-of-phase audio decoder circuit is formed by the connections between the transmitter 42, the first rear preamplifier 27, and the second rear preamplifier 29. The out-of phase signal 46 is transmitted to at least one receiver 44 which feeds the out-of-phase audio signal 46 to a speaker amplifier 54. The left power amplifier 48, the right power amplifier 50, and the center power amplifier 52 drives a left speaker 56, a right speaker 58, and a center speaker 60, respectively.

The left preamplifier 32, right preamplifier 30, first center preamplifier 28, second center preamplifier 26, first rear preamplifier 27, and second rear preamplifier 29 are powered by a first DC power supply 16. The transmitter 42, left power amplifier 48, right preamplifier 50, and center power amplifier 52 are powered by a second DC power supply 17. The grounds of the first DC power supply 16 and the second DC power supply 17 float in relation to each other.

A remote power amplifier 12 comprises a receiver 44 and a speaker amplifier 54. The receiver 44 receives an out-of-phase audio signal 46 transmitted from the transmitter 42, the out-of-phase audio signal 46 is input into the speaker amplifier 54 which drives the rear speaker 62. Speaker amplifier 54 can drive more than one rear speaker if a left and right rear speaker or subwoofer is desired. The transmitter 42 and receiver 44 may operate on low power FM or at 2.4 Gigahertz.

Figure 3:
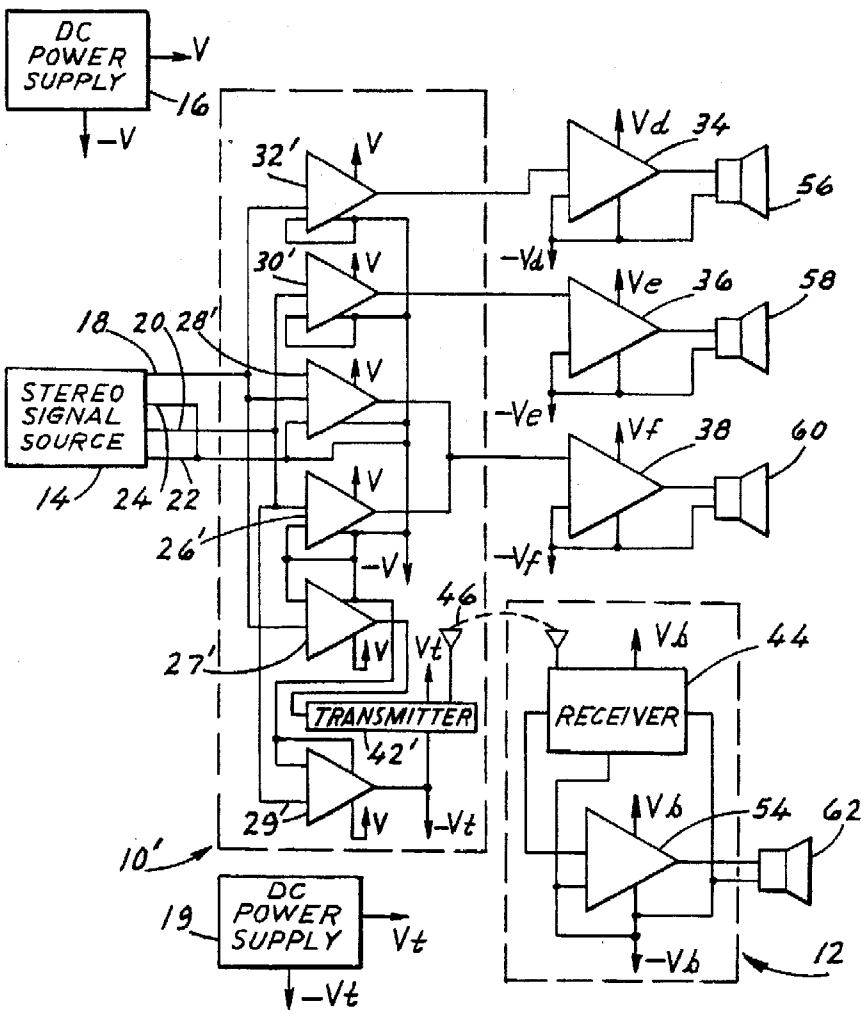
FIG. 3 is a schematic diagram of a second preferred embodiment of a surround sound processor unit in accordance with the present invention.

FIG. 3 shows a schematic diagram of a second preferred embodiment of a surround sound processor unit 10'. A stereo signal source 14 supplies a left audio signal 18, a right audio signal 20, a left audio signal ground 24, and a right audio signal ground 22. The stereo signal source 14 may be a stereo VCR audio out, a home stereo receiver preamplifier out, a stereo TV audio out, a head phone jack, or a car stereo preamplifier out. The left audio signal ground 24 and the right audio signal ground 22 are both connected to a ground of the first DC power supply 16.

The left audio signal 18 is inputed into a left preamplifier 32', a first center preamplifier 28', and a transmitter 42'. The right audio signal 20 is inputed into a right preamplifier 30', a second center preamplifier 26', a first rear preamplifier 27', and a second rear preamplifier 29'. The surround sound processor unit 10' does not include power amplifiers, the user is given the option of providing power amplifiers that compliment their particular audio set up. The left preamplifier 32' is connected to the input of a left external power amplifier 34. The right preamplifier 30' is connected to the input of a right external power amplifier 36. The output of the first center preamplifier 28' and the second center preamplifier 26' are both input into a center external power amplifier 38. The connection of the output signals from the first center preamplifier 28' and the second center preamplifier 26' to the input of the external center power amplifier 38 form an in-phase audio decoder circuit.

The output signal from the first rear preamplifier 27' is input into the transmitter 42' and the output signal from the sixth preamplifier 29' is connected to the ground of the transmitter 42'. The out-of-phase audio decoder circuit is formed by the connections between between the transmitter 42', the first rear preamplifier 27', and the second rear preamplifier 29'. The out-of phase signal 46 is transmitted to at least one receiver 44 which feeds the out-of-phase audio signal 46 to a speaker amplifier 54. The left external power amplifier 34, the right power amplifier 36, and the center power amplifier 38 drives a left speaker 56, a right speaker 58, and a center speaker 60, respectively.

The left preamplifier 32', right preamplifier 30', first center preamplifier 28', second center preamplifier 26', first rear preamplifier 27', and second rear preamplifier 29' are powered by a first DC power supply 16. The transmitter 42' is powered by a DC transmitter power supply 19. The grounds of the first DC power supply 16 and the DC transmitter power supply 19 float in relation to each other.

A remote power amplifier 12 comprises a receiver 44 and a speaker amplifier 54. The receiver 44 receives an out-of-phase audio signal 46 transmitted from the transmitter 42', the out-of-phase audio signal 46 is input into the speaker amplifier 54 which drives at least one rear speaker 62. The transmitter 42' and receiver 44 may operate on low power FM or at 2.4 Gigahertz.

Figure 4:
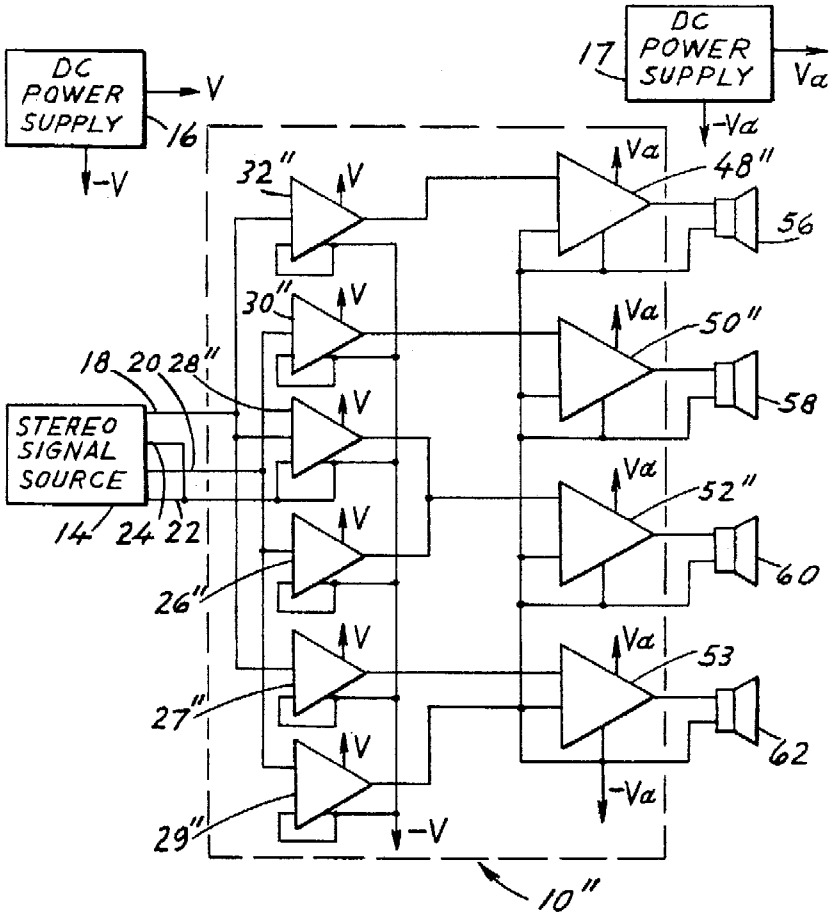
FIG. 4 is a schematic diagram of a third preferred embodiment of a surround sound processor unit in accordance with the present invention.

FIG. 4 shows a schematic diagram of a third preferred embodiment of a surround sound processor unit 10". The surround sound processor unit 10" lacks the wireless transmission feature for at least one rear speaker 62. A stereo signal source 14 supplies a left audio signal 18, a right audio signal 20, a left audio signal ground 24, and a right audio signal ground 22. The stereo signal source 14 may be a stereo VCR audio out, a home stereo receiver preamplifier out, a stereo TV audio out, a headphone jack, or a car stereo preamplifier out. The left audio signal ground 24 and the right audio signal ground 22 are both connected to a ground of the first DC power supply 16.

The left audio signal 18 is inputed into a left preamplifier 32", a first center preamplifier 28", and a first rear preamplifier 27. The right audio signal 20 is inputed into a right preamplifier 30", a second center preamplifier 26", and a second rear preamplifier 29". The left preamplifier 32" is connected to the input of a left power amplifier 48". The right preamplifier 30" is connected to the input of a right power amplifier 50". The output of the first center preamplifier 28" and the second center preamplifier 26" are both input into a center power amplifier 52". The connection of the output signals from the first center preamplifier 28" and the second center preamplifier 26" to the input of the center power amplifier 52" form an in-phase audio decoder circuit. The output of the first rear preamplifier 27" is input into a rear power amplifier 53, and the output of the second rear preamplifier 29" is connected to a ground thereof. The out-of-phase audio decoder circuit is formed by the connections between the rear power amplifier 53, the first rear preamplifier 27", and the second rear preamplifier 29".

The left power amplifier 48", the right power amplifier 50", the center power amplifier 52", and the rear power amplifier 53 drives the left speaker 56, the right speaker 58, the center speaker 60, and at least one rear speaker 62, respectively. The left preamplifier 32", right preamplifier 30", first center preamplifier 28", second center preamplifier 26", first rear preamplifier 27", and second rear preamplifier 29" are power by a first DC power supply 16. The left power amplifier 48", right preamplifier 50", center power amplifier 52", and rear power amplifier 53 are powered by a second DC power supply 17. The grounds of the first DC power supply 16 and the second DC power supply 17 float in relation to each other.

Figure 5:
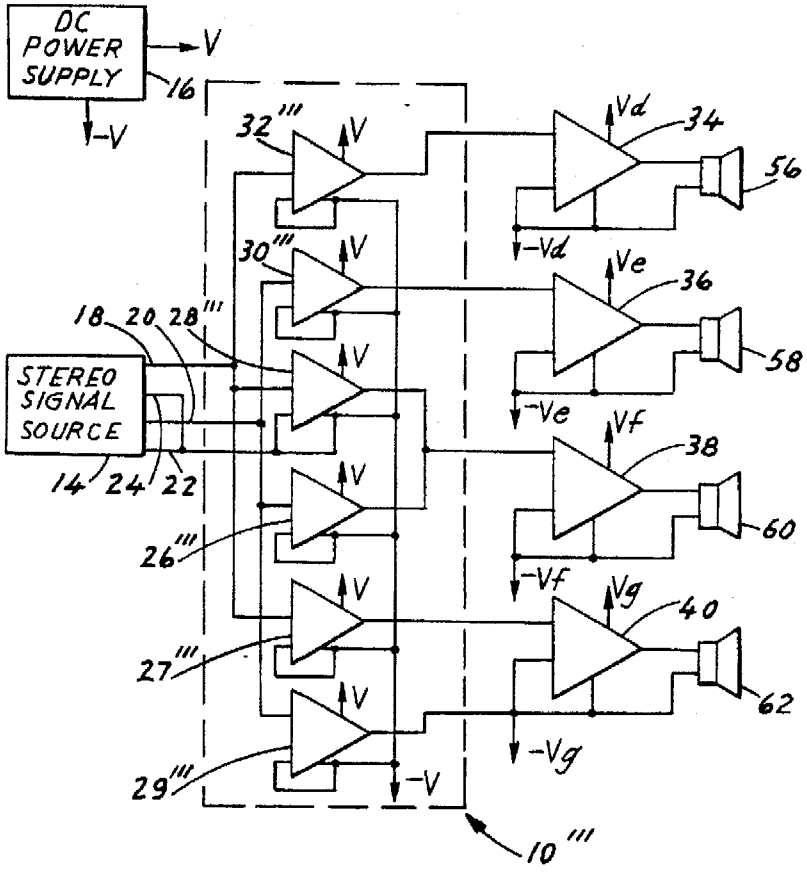
FIG. 5 is a schematic diagram of a fourth preferred embodiment of a surround sound processor unit in accordance with the present invention.

FIG. 5 shows a schematic diagram of a fourth preferred embodiment of a surround sound processor unit 10'". The surround sound processor unit 10'" lacks the wireless transmission feature for the rear speaker 62. A stereo signal source 14 supplies a left audio signal 18, a right audio signal 20, a left audio signal ground 24, and a right audio signal ground 22. The stereo signal source 14 may be a stereo VCR audio out, a home stereo receiver preamplifier out, a stereo TV audio out, a headphone jack, or a car stereo preamplifier out. The left audio signal ground 24 and the right audio signal ground 22 are both connected to a ground of the first DC power supply 16.

The left audio signal 18 is inputed into a left preamplifier 32'", a first center preamplifier 28'", and a first rear preamplifier 27'". The right audio signal 20 is inputed into a right preamplifier 30'", a second center preamplifier 26'", and a second rear preamplifier 29'". The surround sound processor unit 10' does not include power amplifiers, the user is given the option of providing power amplifiers that compliment their particular audio set up. The left preamplifier 32'" is connected to the input of a left external power amplifier 34. The right preamplifier 30'" is connected to the input of a right external power amplifier 36. The output of the first center preamplifier 28'" and the second center preamplifier 26'" are both input into a center external power amplifier 38. The connection of the output signals from the first center preamplifier 28'" and the second center preamplifier 26'" to the input of the center external power amplifier 38 form an in-phase audio decoder circuit.

The output of the first rear preamplifier 27'" is input into a rear external power amplifier 40, and the output of the second rear preamplifier 29'" is connected to a ground of the rear external power amplifier 40. The out-of-phase audio decoder circuit is formed by the connections between the external power amplifier 40, the first rear preamplifier 27'", and the second rear preamplifier 29'".

The left external power amplifier 34, the right external power amplifier 36, the center external power amplifier 38, and the rear external power amplifier 40 drives a left speaker 56, a right speaker 58, a center speaker 60, and at least one rear speaker 62, respectively. The left preamplifier 32'", right preamplifier 30'", first center preamplifier 28'", second center preamplifier 26'", first rear preamplifier 27'", and the second rear preamplifier 29'" are powered by a DC regulated power supply 16.

Figure 6:
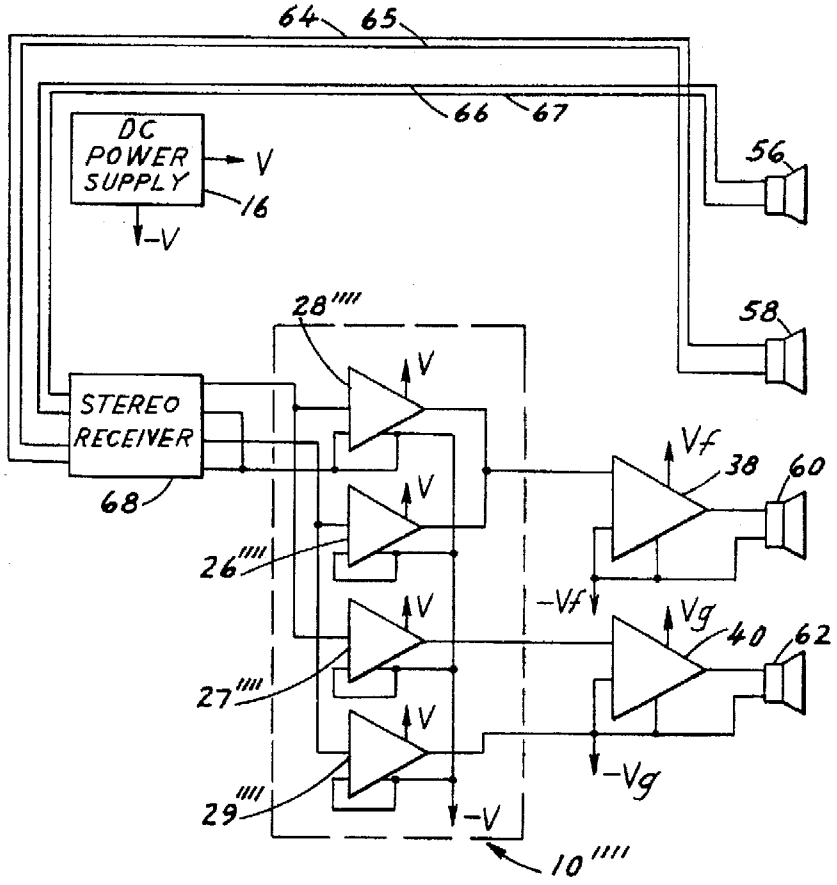
FIG. 6 is a schematic diagram of a fifth preferred embodiment of a surround sound processor unit in accordance with the present invention.

FIG. 6 shows a schematic diagram of a fifth preferred embodiment of a surround sound processor unit 10"". The surround sound processor unit 10"" is similar to the fourth preferred embodiment, but lacks the left preamplifier 32'", right preamplifier 30'", left external power amplifier 34, and right external power amplifier 36. The stereo signal source is preferably a stereo receiver 68, but could also be any type of stereo audio amplifier such as a boom box or even a car stereo. A right audio signal 64 and a right audio signal ground 65 from the stereo receiver 68 drive right speaker 58. A left audio signal 66 and a left audio signal ground 67 from the stereo receiver 68 drive left speaker 56. A first center preamplifier 28 "", a second center preamplifier 26 "", a first rear preamplifier 27 "", and a second rear preamplifier 29 "" can be driven from a stereo output of the stereo receiver 68 such as a headphone jack, tape out, or preamplifier out. The preferred embodiments of FIGS. 2, 3 & 4 may also be converted from a five channel surround sound unit to a three channel add-on surround sound unit by removing the left and right preamplifiers and amplifiers.

While particular embodiments of the invention have been shown and described, it will be obvious to those skilled in the art that changes and modifications such as master volume controls, LED meters, noise reduction, remote controls, variable gain resistors, or balance controls may be made without departing from the invention in its broader aspects, and therefore, the aim in the appended claims is to cover all such changes and modifications as fall within the true spirit and scope of the invention.

I claim:

1. A surround sound processor unit comprising:

a first center preamplifier, a second center preamplifier, a first rear preamplifier, and a second rear preamplifier;

a transmitter; and a center power amplifier, wherein a left audio signal being input into said first center preamplifier and said first rear preamplifier, a right audio signal being input into said second center preamplifier and said second rear preamplifier, the output of said first center preamplifier and said second center preamplifier being input into said center power amplifier, the output of said first rear preamplifier being input into said transmitter, the output of said second rear preamplifier being connected to a ground of said transmitter.

2. The surround sound processor unit of claim 1, further comprising:

a left preamplifier, a right preamplifier;

a receiver; and a left power amplifier, and a right power amplifier, wherein a left audio signal being input into said left preamplifier, a right audio signal being input into said right preamplifier, the output of said left preamplifier being input into said left power amplifier, the output of said right preamplifier being input into said right power amplifier; and a speaker amplifier, wherein an out-of-phase audio signal being transmitted from said transmitter to said receiver, said out-of-phase audio signal being input into said speaker amplifier from said receiver, said left power amplifier, said right power amplifier, said center power amplifier, and said speaker amplifier driving a left speaker, a right speaker, a center speaker and at least one rear speaker, respectively.

3. The surround sound processor unit of claim 1, wherein:

said first center preamplifier output being connected to said second center preamplifier output, the input of said center power amplifier being connected to said first center preamplifier output and to said second center preamplifier output, wherein an in-phase audio signal being decoded from said left audio signal and said right audio signals.

4. The surround sound processor unit of claim 1, wherein:

said first rear preamplifier being input by said transmitter, said second rear preamplifier being connected to the ground of said transmitter, wherein an out-of-phase audio signal being decoded from said left audio signal and said right audio signal, said out-of-phase audio signal being transmitted from said transmitter to said receiver.

5. The surround sound processor unit of claim 1, wherein:

a receiver;

a stereo audio amplifier; and a speaker amplifier, wherein an out-of-phase audio signal being transmitted from said transmitter to said receiver, said out- of-phase audio signal being input into said speaker amplifier from said receiver, said left audio signal of said stereo audio amplifier, said right audio signal of said stereo audio amplifier, said center power amplifier, and said speaker amplifier driving a left speaker, a right speaker, a center speaker and at least one rear speaker, respectively.

6. A surround sound processor unit comprising:

a first center preamplifier, a second center preamplifier, a first rear preamplifier, and a second rear preamplifier; and a transmitter, wherein a left audio signal being input into said first center preamplifier and said first rear preamplifier, a right audio signal being input into said second center preamplifier and said second rear preamplifier, the output of said first center preamplifier and said second center preamplifier being connected together, the output of said first rear preamplifier being input into said transmitter, the output of said second rear preamplifier being connected to the ground of said transmitter.

7. The surround sound processor unit of claim 6, further comprising:

a left preamplifier, a right preamplifier;

a receiver;

a left external power amplifier, a right external power amplifier, and a center external power amplifier, wherein a left audio signal being input into said left preamplifier, a right audio signal being input into said right preamplifier, the output of said left preamplifier being input into said left external power amplifier, the output of said right preamplifier being input into said right external power amplifier, the outputs of said first center preamplifier and said second center preamplifier being input into said center external power amplifier; and a speaker amplifier, wherein an out-of-phase audio signal being transmitted from said transmitter to said receiver, said out- of-phase audio signal being input into said speaker amplifier from said receiver, said left external power amplifier, said right external power amplifier, said center external power amplifier, and said speaker amplifier driving a left speaker, a right speaker, a center speaker and at least one rear speaker, respectively.

8. The surround sound processor unit of claim 6, wherein:

said first center preamplifier output being connected to said second center preamplifier output, the input of said center power amplifier being connected to said first center preamplifier output and to said second center preamplifier output, wherein an in-phase audio signal being decoded from said left audio signal and said right audio signals.

9. The surround sound processor unit of claim 6, wherein:

said first rear preamplifier being input by said transmitter, said second rear preamplifier being connected to the ground of said transmitter, wherein an out-of-phase audio signal being decoded from said left audio signal and said right audio signal, said out-of-phase audio signal being transmitted from said transmitter to said receiver.

10. The surround sound processor unit of claim 6, wherein:

a receiver;

a center external power amplifier;

a stereo audio amplifier; and a speaker amplifier, wherein an out-of-phase audio signal being transmitted from said transmitter to said receiver, said out-of-phase audio signal being input into said speaker amplifier from said receiver, said left audio signal of said stereo audio amplifier, said right audio signal of said stereo audio amplifier, said center external power amplifier, and said speaker amplifier driving a left speaker, a right speaker, a center speaker and at least one rear speaker, respectively.

11. A surround sound processor unit comprising:

a first center preamplifier, a second center preamplifier, a first rear preamplifier, and a second rear preamplifier;

a center power amplifier, and a rear power amplifier, wherein a left audio signal being input into said first center preamplifier and said first rear preamplifier, a right audio signal being input into said second center preamplifier and said second rear preamplifier, the output of said first center preamplifier and said second center preamplifier being input into said center power amplifier, the output of said first rear preamplifier being input into said rear power amplifier, the output of said second rear preamplifier being connected to a ground of said rear power amplifier.

12. The surround sound processor unit of claim 11, further comprising:

a left preamplifier, a right preamplifier, and a left power amplifier, and a right power amplifier, wherein a left audio signal being input into said left preamplifier, a right audio signal being input into said right preamplifier, the output of said left preamplifier being input into said left power amplifier, the output of said right preamplifier being input into said right power amplifier, said left power amplifier, said right power amplifier, said center power amplifier, and said rear power amplifier driving a left speaker, a right speaker, a center speaker, and at least one rear speaker, respectively.

13. The surround sound processor unit of claim 11, wherein:

said first center preamplifier output being connected to said second center preamplifier output, the input of said center power amplifier being connected to said first center preamplifier output and to said second center preamplifier output, wherein an in-phase audio signal being decoded from said left audio signal and said right audio signals.

14. The surround sound processor unit of claim 11, wherein:

said first rear preamplifier being input by said rear power amplifier, said second rear preamplifier being connected to the ground of said rear power amplifier, wherein an out-of-phase audio signal being decoded from said left audio signal and said right audio signal, said out-of-phase audio signal.

15. The surround sound processor unit of claim 11, wherein:

a stereo audio amplifier, wherein said left audio signal of said stereo audio amplifier, said right audio signal of said stereo audio amplifier, said center power amplifier, and said rear power amplifier driving a left speaker, a right speaker, a center speaker, and at least one rear speaker, respectively.

16. A surround sound processor unit comprising:

a first rear preamplifier, and a second rear preamplifier;

a rear power amplifier, wherein a left audio signal being input into said first rear preamplifier, a right audio signal being input into said second rear preamplifier, the output of said first rear preamplifier being input by said rear power amplifier, said second rear preamplifier being connected to the ground of said rear power amplifier.

17. The surround sound processor unit of claim 16, further comprising:

a left preamplifier, a right preamplifier, a left power amplifier, a right power amplifier, wherein a left audio signal being input into said left preamplifier, a right audio signal being input into said right preamplifier, the output of said left preamplifier being input into said left power amplifier, the output of said right preamplifier being input into said right power amplifier, said left power amplifier driving a left speaker, said right power amplifier driving a right speaker.

18. The surround sound processor unit of claim 16, further comprising:

a first center preamplifier, a second center preamplifier, and a center power amplifier, said first center preamplifier output being connected to said second center preamplifier output, the input of said center power amplifier being connected to said first center preamplifier output and to said second center preamplifier output, wherein an in-phase audio signal being decoded from said left audio signal and said right audio signals, said center power amplifier driving a center speaker.

19. The surround sound processor unit of claim 16, wherein:

said first rear preamplifier being input by said rear power amplifier, said second rear preamplifier being connected to the ground of said rear power amplifier, wherein an out-of-phase audio signal being decoded from said left audio signal and said right audio signal, said out-of-phase audio signal, said rear power amplifier driving a rear speaker.

20. A method for decoding out-of-phase audio signals from a stereo audio signal for surround sound systems comprising:

(a) inputing a left audio signal into a first preamplifier;

(b) inputing a right audio signal into a second preamplifier;

(c) inputing the output of said first preamplifier into a power amplifier; and (d) connecting the output of said second preamplifier to the ground of said power amplifier, wherein the output of said power amplifier produces an out-of-phase audio signal for at least one rear channel speaker.

* * * * *